US007862138B2

(12) United States Patent
Haines et al.

(10) Patent No.: US 7,862,138 B2
(45) Date of Patent: Jan. 4, 2011

(54) FLOW CONTROL IN AN INK PEN

(75) Inventors: Paul Mark Haines, Corvallis, OR (US); Mark A. Devries, Corvallis, OR (US); Craig L. Malik, Corvallis, OR (US); Ronald J. Ender, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 464 days.

(21) Appl. No.: 11/867,236

(22) Filed: Oct. 4, 2007

(65) Prior Publication Data

US 2009/0091606 A1 Apr. 9, 2009

(51) Int. Cl.
*B41J 29/38* (2006.01)
*B41J 2/175* (2006.01)

(52) U.S. Cl. ..... 347/17; 347/85

(58) Field of Classification Search ..... 347/17, 347/85, 86

See application file for complete search history.

(56) References Cited

U.S. PATENT DOCUMENTS 6,508,545 B2 1/2003 Dowell
2002/0149646 A1 * 10/2002 Pawlowski et al. ..... 347/50
2004/0257413 A1 12/2004 Anderson

FOREIGN PATENT DOCUMENTS

JP 08156280 A * 6/1996
JP 09-118021 A 6/1997

OTHER PUBLICATIONS

International Search Report dated Mar. 31, 2009 for PCT Application No. PCT/US2008/078629 Filing Date Oct. 2, 2008.

* cited by examiner

*Primary Examiner*—Matthew Luu
*Assistant Examiner*—Jannelle M Lebron

(57) ABSTRACT

In one embodiment a pressure regulator for an ink pen includes: a diaphragm between a lower pressure region and a higher pressure region, the diaphragm movable toward the lower pressure region in response to an increase in a pressure difference across the diaphragm; a valve operative between an open position in which ink may flow into the lower pressure region and a closed position in which ink may not flow into the lower pressure region; a first lever rotatable on a first fulcrum in response to movement of the diaphragm toward the lower pressure region; and a second lever connected to the valve, the second lever rotatable on a second fulcrum in response to rotation of the first lever to move the valve from the closed position to an open position.

12 Claims, 7 Drawing Sheets

FLOW CONTROL IN AN INK PEN

BACKGROUND

The physical size of an inkjet printer ink pen directly affects the size and cost of the printer. (An ink pen is also commonly referred to as an ink cartridge or an inkjet printhead assembly.) The bigger, higher performance inkjet pens used in some high end office printers require extensive structure and actuators to properly position the pens in the printer, enlarging both the size and the cost of the printer. The ink filtering and flow control components in the ink delivery system in higher performance ink pens are some of the bulkiest components in the pen. These components are embedded in the body of the pen and, therefore, contribute to a large part of the pen size. By reducing the size of the ink filtering or the flow control components, or both, the size of the pen may be significantly reduced.

DRAWINGS

DESCRIPTION

Embodiments of the present disclosure were developed in an effort to reduce the size of a higher performance, "off axis" inkjet ink pen. Exemplary embodiments of the disclosure will be described, therefore, with reference to an off axis ink pen and an inkjet printer. Embodiments of the disclosure, however, are not limited to the exemplary ink pen or printer shown and described below. Other forms, details, and embodiments may be made and implemented. Hence, the following description should not be construed to limit the scope of the disclosure, which is defined in the claims that follow the description.

As used in this document: "diaphragm" means a sheet anchored along its periphery that serves as a barrier between two regions and moves in response to pressure changes between the two regions; and "lever" means a structurally stable member that rotates about a point of support in response to counteracting forces acting on the member. The support on which a lever rotates is called the fulcrum. While a lever may be flexible to some degree, it must be able to withstand counteracting forces without buckling. Thus, the lever must be a "structurally stable" member. A lever in which the fulcrum is located between the places where counteracting forces act on the member is commonly referred to as a first class lever. A lever in which the fulcrum is located on one side of the places where counteracting forces act on the member is commonly referred to as either a second class lever or a third class lever, depending on the location and characterization of an input force/effort and an output force/load.

Figure 1:
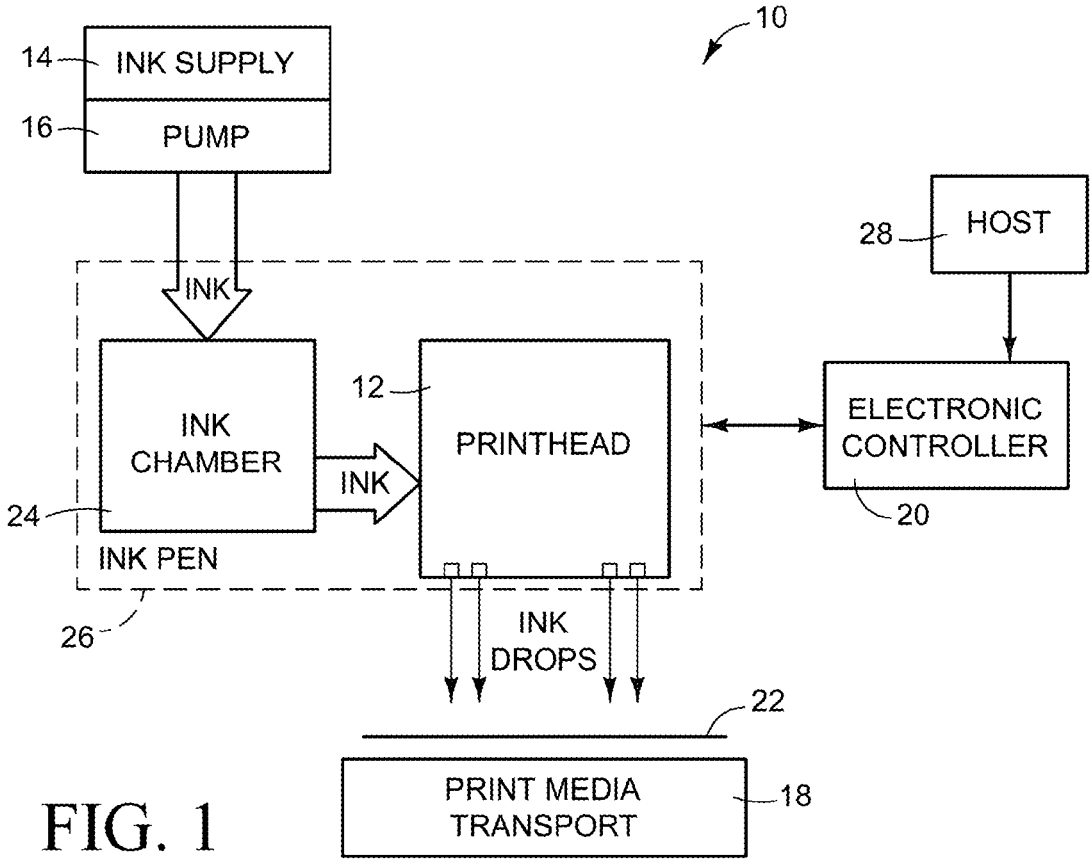
FIG. 1 is a block diagram illustrating an inkjet printer.

Referring to FIG. 1, inkjet printer 10 includes a printhead 12, an ink supply 14, a pump 16, a print media transport mechanism 18, and an electronic printer controller 20. Printhead 12 in FIG. 1 represents generally one or more printheads and the associated mechanical and electrical components for ejecting drops of ink on to a sheet or strip of print media 22. A typical thermal inkjet printhead includes a nozzle plate arrayed with ink ejection nozzles and firing resistors formed on an integrated circuit chip positioned behind the ink ejection nozzles. The ink ejection nozzles are usually arrayed in columns along the nozzle plate. Each printhead is operatively connected to printer controller 20 and ink supply 14. In operation, printer controller 20 selectively energizes the firing resistors and, when a firing resistor is energized, a vapor bubble forms in the ink vaporization chamber, ejecting a drop of ink through a nozzle on to the print media 22. In a piezoelectric printhead, piezoelectric elements are used to eject ink from a nozzle. Piezoelectric elements located close to the nozzles are caused to deform very rapidly to eject ink through the nozzles.

An ink chamber 24 and printhead 12 are often housed together in an ink pen 26, as indicated by the dashed line in FIG. 1. Ink flows to printhead 12 from ink supply 14 through ink chamber 24. Ink pens like ink pen 26, which allow the ink to be replaced as it is consumed from a remote, refillable, ink supply 14, are sometimes referred to as "off axis" pens. Ink chamber 24 represents generally one or more ink chambers 24 in pen 26 through which ink passes on its way to printhead 12. For example, as described below, the ink may pass through a filter chamber and a pressure regulator chamber before reaching the printhead. Printer 10 may include a series of stationary ink pens 26 that span the width of print media 22. Alternatively, printer 10 may include one or more ink pens 26 that are scanned back and forth across the width of media 22 on a moveable carriage. Media transport 18 advances print media 22 past printhead 12. For stationary pens 26, media transport 18 may advance media 22 continuously past printhead 12. For a scanning pen 26, media transport 18 may advance media 22 incrementally past pen 26, stopping as each swath is printed and then advancing media 22 for printing the next swath.

Controller 20 receives print data from a computer or other host device 28 and processes that data into printer control information and image data. Controller 20 controls the movement of the carriage, if any, and media transport 18. As noted above, controller 20 is electrically connected to printhead 12 to energize the firing resistors to eject ink drops on to media 22. By coordinating the relative position of pen(s) 26 and media 22 with the ejection of ink drops, controller 20 produces the desired image on media 22 according to the print data received from host device 28.

Figure 2:
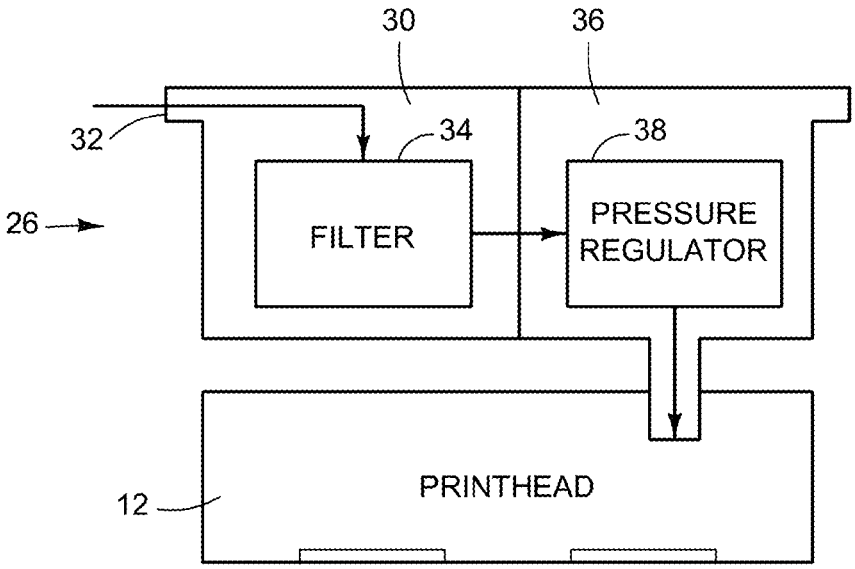
FIG. 2 is a block diagram illustrating one exemplary embodiment of an ink pen.

FIG. 2 is a block diagram illustrating one exemplary embodiment of an ink pen 26. Referring to FIG. 2, ink is pumped into a filter chamber 30 in pen 26 from a separate ink supply (not shown) through an inlet 32. Ink passes through a filter 34 in filter chamber 30 before flowing into a regulator chamber 36. (Ink chamber 24 from FIG. 1, for example, may include a filter chamber 30 and a regulator chamber 36 from the embodiment of ink pen 26 shown in FIG. 2.) Ink flows from regulator chamber 36 to printhead 12 where it may be ejected on to print media as described above. In many inkjet printers, ink flows to the printhead at a slight negative pressure (vacuum) to control the free flow of ink through the ink ejection nozzles when the printhead is not activated. Without such negative pressure, ink may leak or "drool" from the nozzles. Hence, a pressure regulator 38 in chamber 36 maintains the pressure in chamber 36 within a desired range of negative pressures.

Figure 3:
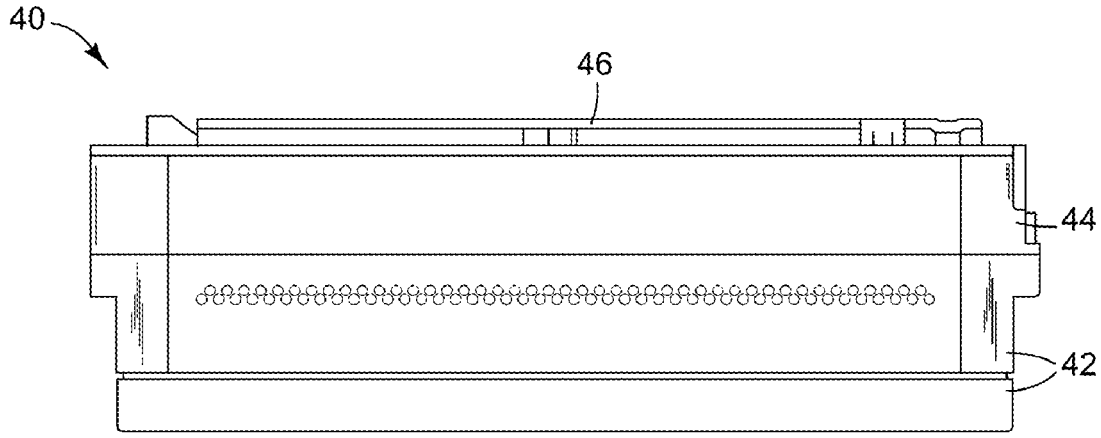
FIG. 3 is an exterior elevation view of one exemplary embodiment of an ink pen.
Figure 4:
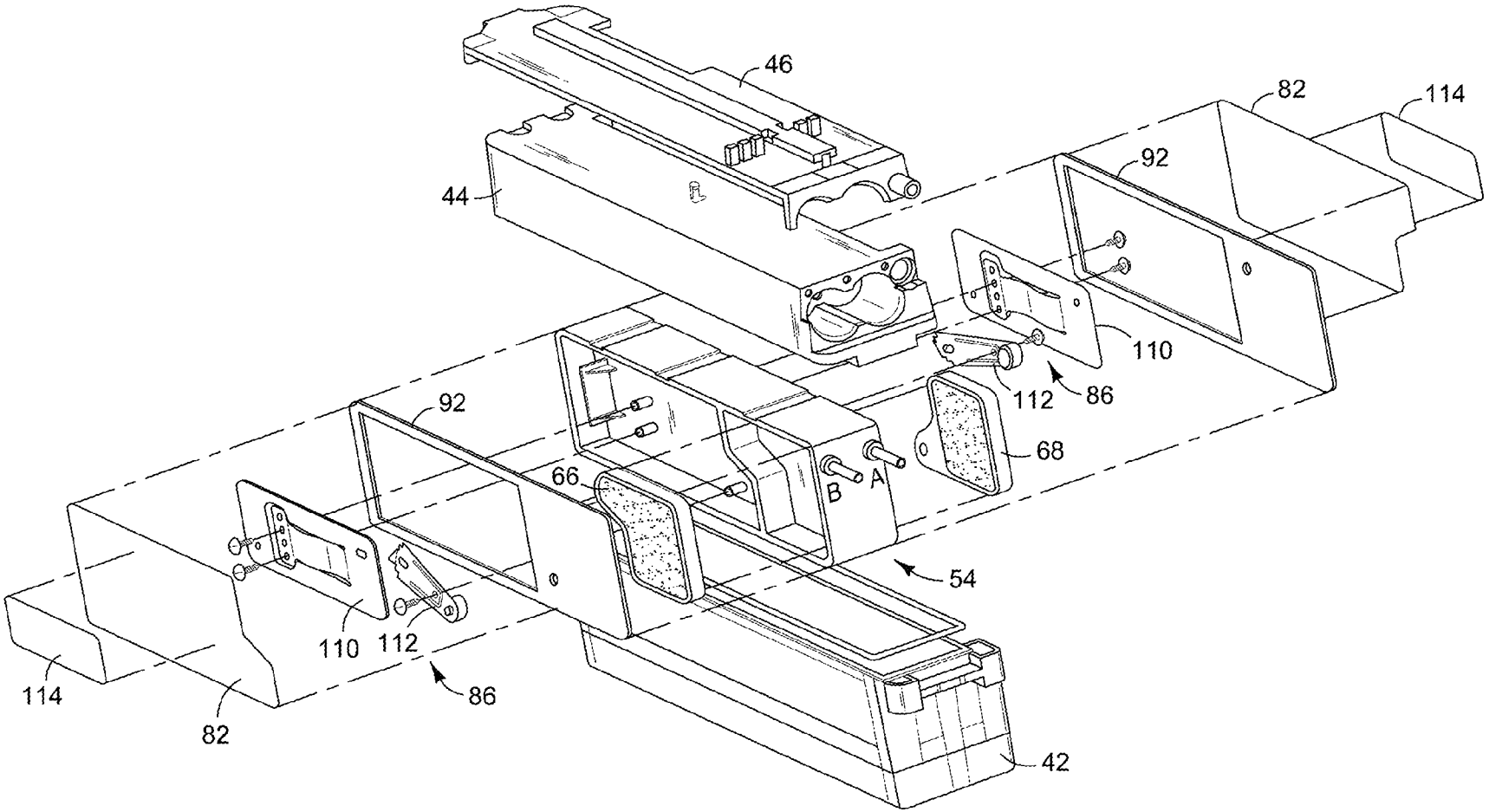
FIG. 4 is an exploded perspective view of an ink pen such as the one shown in FIG. 3.
Figure 5:
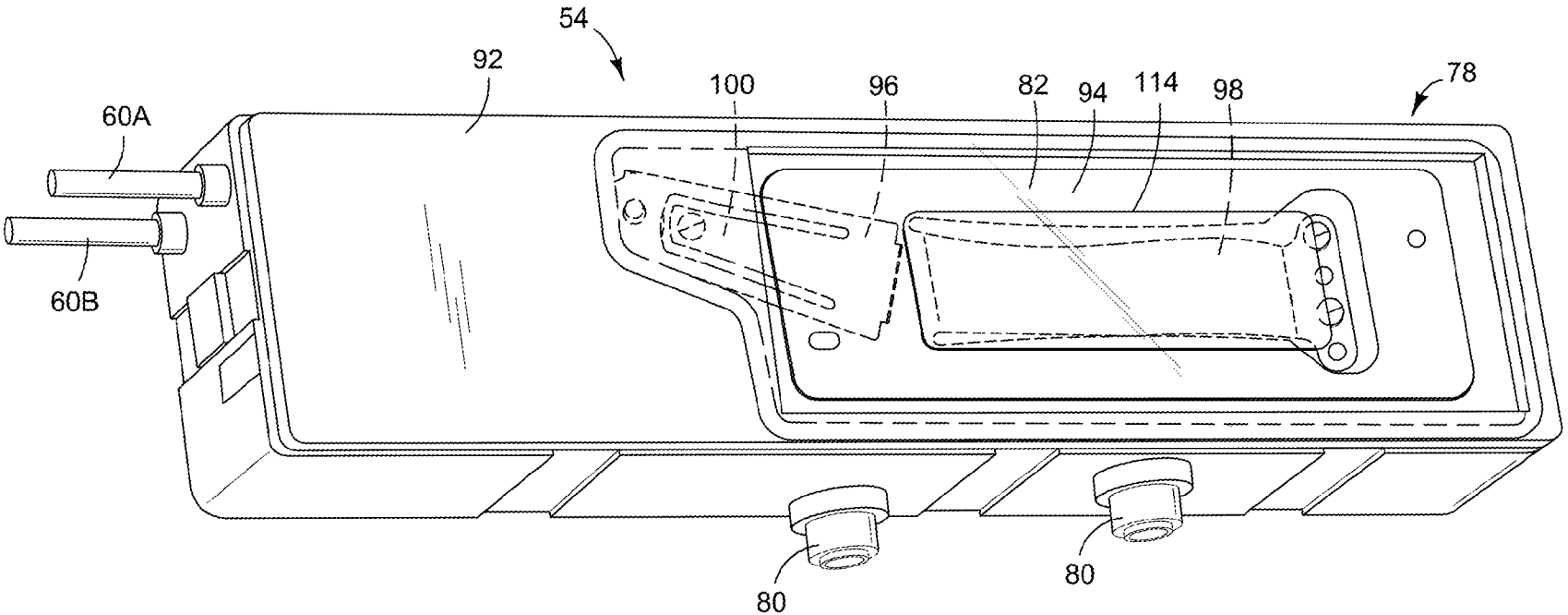
FIG. 5 is a perspective view of the pen body in the ink pen shown in FIG. 4.
Figure 7:
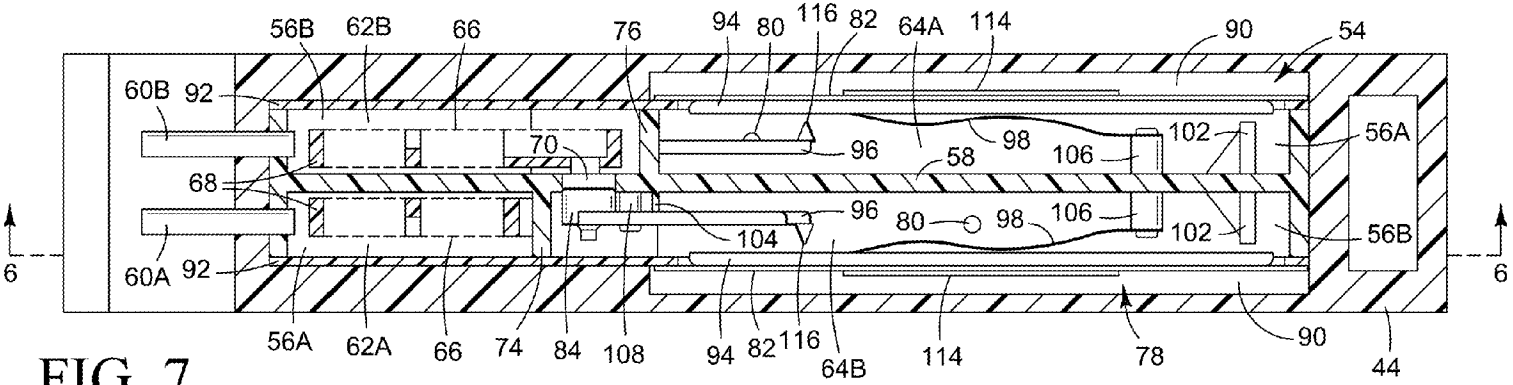
FIG. 7 is a plan section view of the ink pen shown in FIG. 4 taken along the line 7-7 in FIG. 6.
Figure 6:
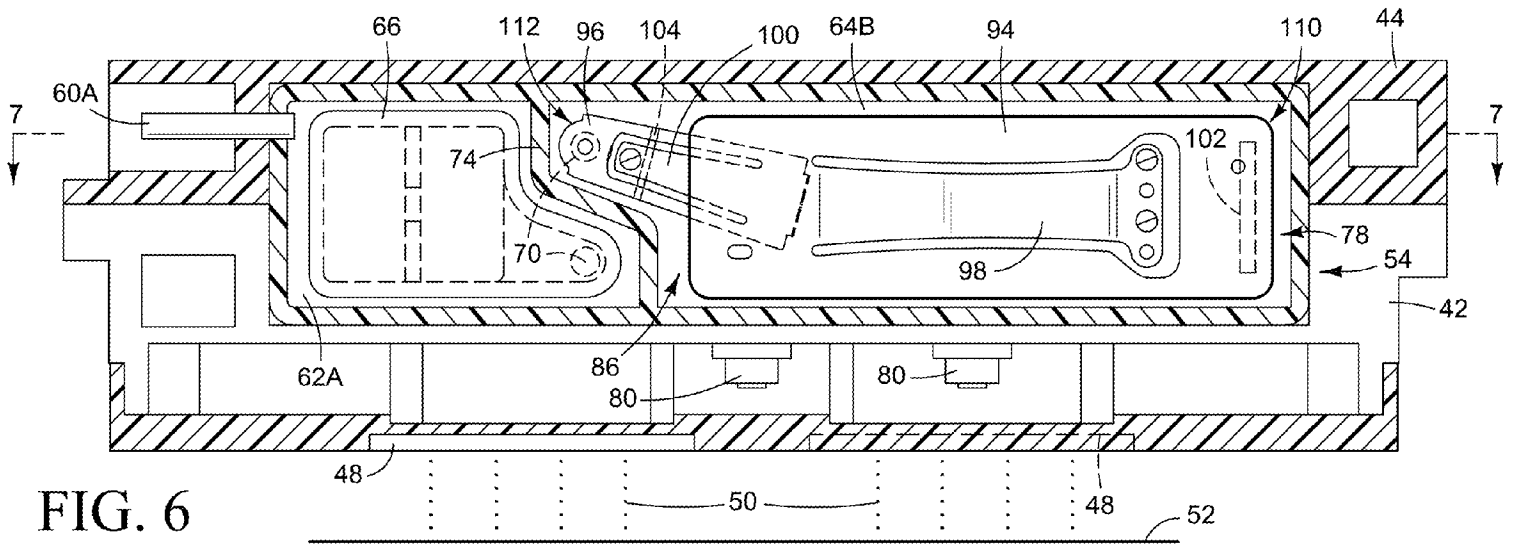
FIG. 6 is an elevation section view of the ink pen shown in FIG. 4 taken along the line 6-6 in FIG. 7.

FIGS. 3-7 illustrate one exemplary embodiment of an ink pen 40 that may be used as a pen 26 shown in the block diagrams of FIGS. 1 and 2. FIG. 3 is an elevation view of the exterior of pen 40. FIG. 4 is an exploded perspective view of ink pen 40. FIG. 5 is a perspective view showing the internal design of the pen body and FIGS. 6 and 7 are elevation and plan section views, respectively, of ink pen 40. Referring first to FIGS. 3-4 and 6, pen 40 includes a lower exterior housing 42, an upper exterior housing 44, and a cover or cap 46. The printheads (not shown) are housed in lower housing 42 so that printhead nozzle plates 48 (FIG. 6) are exposed along the bottom of pen 40 for ejecting ink drops 50 (FIG. 6) on to paper or other print media 52 (FIG. 6). The body 54 of pen 40 is housed within upper and lower housings 42 and 44, as best seen in the section view of FIG. 6.

Referring now to FIGS. 4-7, the exemplary embodiment of ink pen 40 shown is configured to receive and eject two different inks. Pen body 54 is divided lengthwise into units 56A and 56B by a central barrier 58. The exploded perspective of pen 40 in FIG. 4 is viewed looking into the inlet side of pen body unit 56B (which is the outlet side of unit 56A) while the detail perspective of pen body 54 in FIG. 5 is viewed looking into the inlet side of pen body unit 56A (which is the outlet side of unit 56B). Ink flows through each pen body unit 56A and 56B to a separate printhead. When ink pen 40 is installed in a printer, ink inlet ports 60A and 60B are connected to an off axis ink supply and pumping system (not shown in FIGS. 3-7), such as an ink supply 14 and pump 16 illustrated in the block diagram of FIG. 1. Ink is pumped through inlet ports 60A and 60B into corresponding filter chambers 62A and 62B. Ink flows from filter chambers 62A, 62B into a corresponding pressure regulator chamber 64A, 64B. The components described below for each unit 56A and 56B are the same. Therefore, for convenience, the "A" and "B" part number designations are dropped and a single part number used singularly to designate the same component in both the A unit and the B unit.

A filter 66 is supported on a filter frame 68 in each filter chamber 62A, 62B. Filter 66 is supported on both the inboard and outboard faces of filter frame 68. Thus, each filter chamber 62A, 62B is divided into two sub-chambers by filter 66—an exterior/upstream sub-chamber and an interior/downstream sub-chamber. Each ink inlet port 60A, 60B opens into the exterior sub-chamber. An opening in the corner of filter frame 68 exposes the interior filter sub-chamber to a passage 70 through barrier 58 to pressure regulator chambers 64A, 64B. Ink pumped into each exterior filter sub-chamber through inlet ports 60A, 60B passes through filter 66 into the corresponding interior sub-chamber and then out through passage 70 into regulator chambers 64A, 64B. (The flow of ink through pen unit 56A from inlet port 60A to regulator chamber 64B is illustrated by arrows 72 in FIG. 9). An interior barrier 74 separates the A unit filter chamber 62A from the B unit regulator chamber 64B. An interior barrier 76 separates the B unit filter chamber 62B from the B unit regulator chamber 64B.

A pressure regulator 78 in each regulator chamber 64A, 64B controls the flow of ink from filter chamber 62A, 62B into regulator chamber 64A, 64B. Ink flows out of regulator chamber 64A, 64B to the corresponding printhead through an outlet 80. Pressure regulator 78 includes a diaphragm 82, a flow control valve 84 and a linkage 86 linking diaphragm 82 and flow control valve 84. Diaphragm 82 serves as a barrier between regulator chamber 64A, 64B (a lower pressure region) and a higher pressure region 90 at the exterior of regulator chambers 64A, 64B. In the embodiment shown, diaphragm 82 is anchored along its periphery on a frame 92. Diaphragm 82 may be formed, for example, as a thin plastic film heat staked to frame 92. The film may be staked into place with some slack so that the film can collapse inward and expand outward in response to pressure changes in regions 64A, 64B and 90. Any suitable diaphragm 82 may be used. Diaphragm 82 might also be formed, for another example, as an elastic sheet stretched across frame 92.

Linkage 86 includes two levers 94, 96 and two springs 98, 100. Regulator lever 94 rotates on a fulcrum 102 in response to an input force/effort generated by diaphragm 82 moving inward. Valve lever 96 rotates on a fulcrum 104 in response to an input force/effort generated by regulator lever 94 rotating on fulcrum 102. In the embodiment shown, regulator lever 94 is formed as a generally rectangular plate made of metal or another suitable rigid material that bears against diaphragm 82. Lever 94, therefore, is sometimes also referred to as a pressure plate 94. Regulator spring 98 anchored at post 106 urges pressure plate 94 outward against diaphragm 82 to bias diaphragm 82 toward the higher pressure region 90. Valve spring 100 anchored at post 108 urges the input force/effort end of valve lever 96 outward to bias flow control valve 84 toward the closed position.

Figure 12:
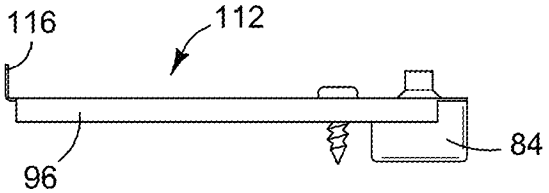
FIGS. 12 and 13 are elevation and plan views, respectively, of a valve link used in a pressure regulator of the ink pen shown in FIGS. 4-7.
Figure 13:
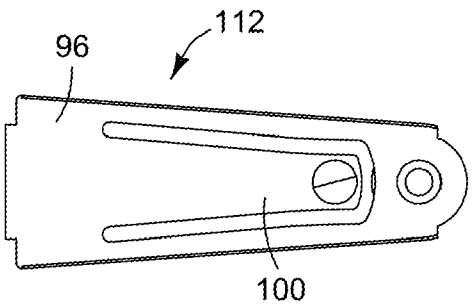
Figure 10:
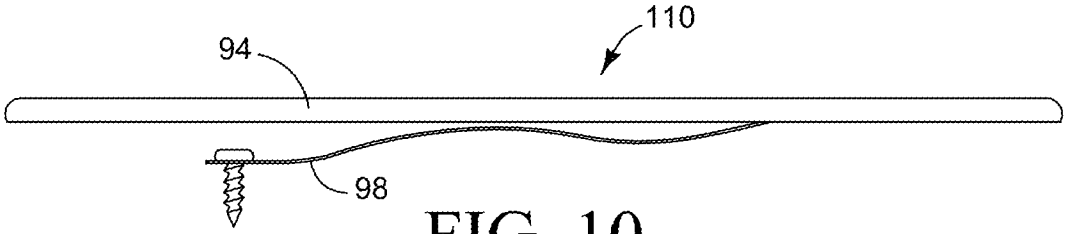
FIGS. 10 and 11 are elevation and plan views, respectively, of a regulator link used in a pressure regulator of the ink pen shown in FIGS. 4-7.
Figure 11:
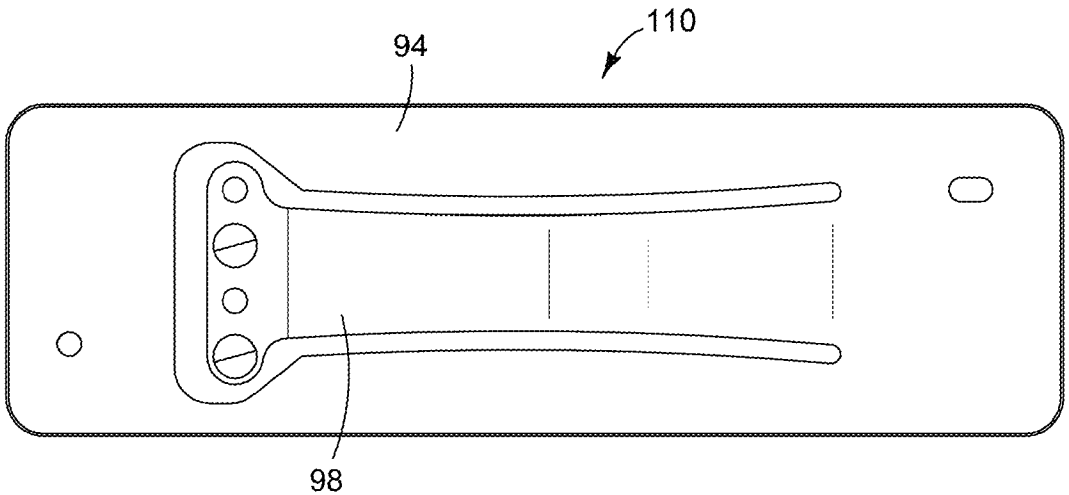

In the embodiment shown, regulator lever 94 and spring 98 are combined in a single part, referred to as regulator link 110. Link 110 is shown in detail in FIGS. 10 and 11. Referring to FIGS. 10 and 11, regulator spring 98 is a leaf spring formed as a tang that extends along the central portion of pressure plate 94. Also, tang/spring 98 extends toward the interior of chamber 64A, 64B. This configuration allows pressure plate 94 to translate and rotate as described below without tang/spring 98 contacting diaphragm 82. A rolled edge around pressure plate 94 helps prevent damage to diaphragm 82. In the embodiment shown, valve lever 96 and valve spring 100 are combined in a single part, referred to as valve link 112. Link 112 is shown in detail in FIGS. 12 and 13. Referring to FIGS. 12 and 13, valve spring 100 is a leaf spring formed as a tang that extends along the central portion of valve lever 96.

Figure 8:
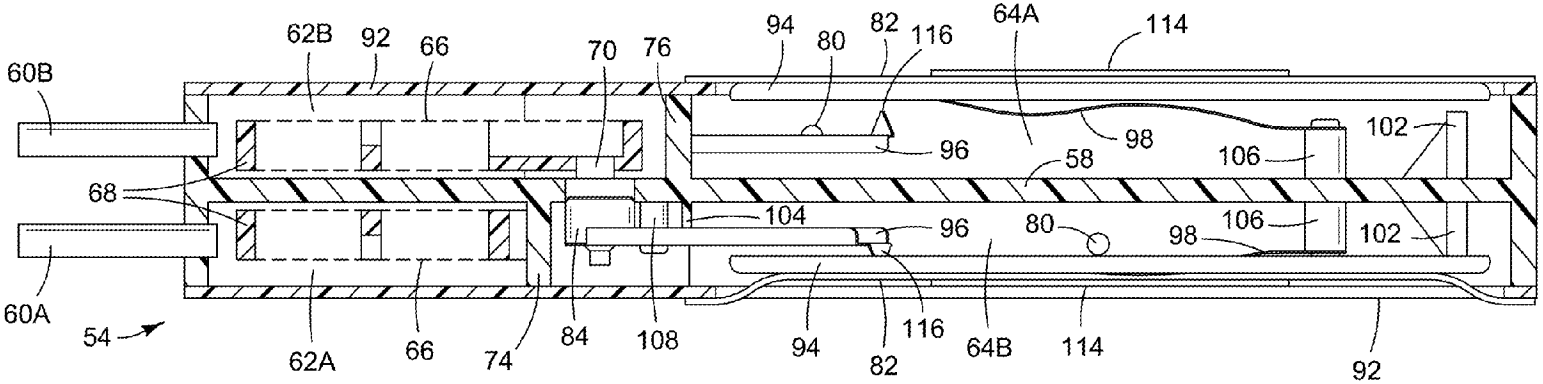
FIGS. 8 and 9 are plan section views of the pen body of FIGS. 4-7 showing the position of operative components of a pressure regulator during actuation of a flow control valve.
Figure 9:
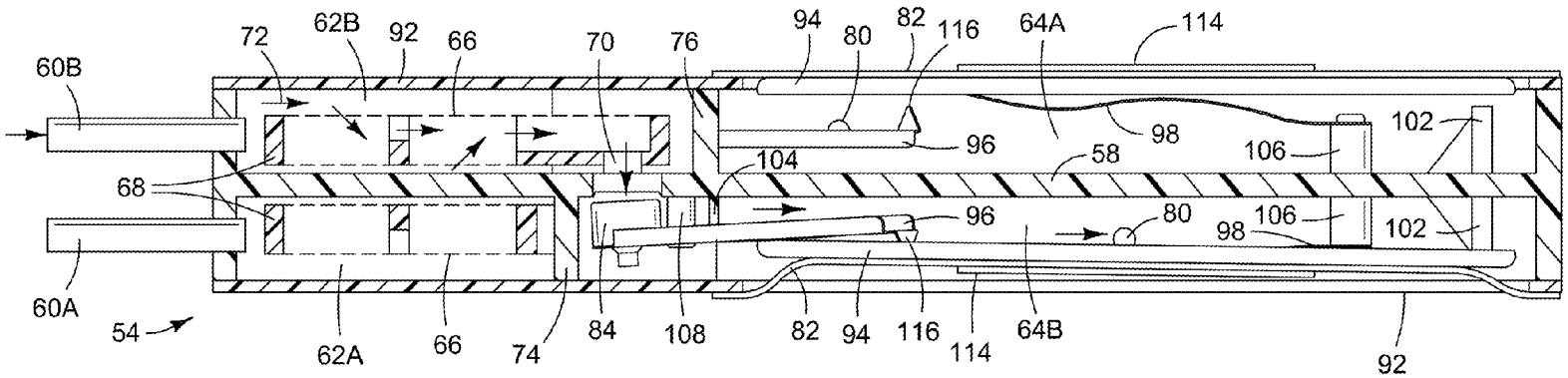

The operation of pressure regulator 78 may be seen by comparing the position of the regulator components in FIGS. 7-9 for regulator chamber 64B. In FIG. 7 pressure regulator 78 is at a steady state in which regulator chamber 64B is holding ink at a slight negative pressure. Regulator spring 98 is urging pressure plate 94 out on diaphragm 82 against the ambient pressure, usually atmospheric pressure, in higher pressure region 90. Valve spring 100 is urging flow control valve 84 toward the closed position to prevent ink from flowing through passage 70 into regulator chamber 64B. A stiffener 114 may be added to the center area of diaphragm 82 spanning the opening in pressure plate 94 for spring 98 if necessary or desirable to strengthen diaphragm 82. Stiffener 114 may be formed, for example, as an additional thickness of the same plastic film from which diaphragm 82 is formed. Stiffener 114 might also be formed, for another example, from a more rigid material affixed to diaphragm 82.

Now, comparing FIGS. 7 and 8, ejecting ink from the printhead lowers the pressure in chamber 64B and, accordingly, increases the pressure differential across diaphragm 82. The increasing pressure differential presses diaphragm 82 and pressure plate 94 inward. Pressure plate 94 translates inward until hitting fulcrum 102 as shown in FIG. 8. Then, pressure plate 94 rotates on fulcrum 102 until it contacts valve lever 96, at a projecting tip 116 for example. The pressure in chamber 64B continues to decrease as ink is ejected from the printhead until the rotating pressure plate 94 engages and rotates valve lever 96 on fulcrum 104 to open valve 84, as shown in FIG. 9, allowing ink to flow into regulator chamber 64B. Ink from the pressurized filter chamber 62B flowing into regulator chamber 64B increases the pressure in chamber 64B, decreasing the pressure differential across diaphragm 82. The decreasing pressure differential allows regulator spring 98 to move pressure plate 94 outward. Pressure plate 94 first rotates outward, disengaging valve lever 96 and allowing valve spring 100 to close valve 84, and then translates outward to return to the steady state position shown in FIG. 7. This process of opening and closing flow control valve 84 and filling regulator chamber 64B with ink is repeated over and over in order to supply ink to the printhead at the desired pressure.

Pressure plate 94 and valve lever 96 are positioned relative to one another such that pressure plate 94 can "float" inward and outward without opening and closing valve 84. This configuration allows regulator 78 to supply ink to the printhead through a range of pressures and to compensate for air trapped in chamber 64A, 64B. During times of temperature or atmospheric variation, any air accumulated in chamber 64A, 64B will change volume. This volume change may be accommodated by moving diaphragm 82 outward or allowing diaphragm 82 to move inward, expanding or contracting the volume of chamber 64A, 64B, to maintain the desired back pressure in chamber 64A, 64B.

The use of both translation and rotation in pressure plate 94 helps reduce the area needed to open and the close flow control valve while still allowing necessary or desirable accommodation of volume changes in the regulator chamber and, hence, helps reduce pen size. Combining each of the lever and spring functions into a single part (regulator link 110 and valve link 112) also helps reduce pen size, simplify pen assembly and permit a cleaner assembly.

As noted at the beginning of this Description, the exemplary embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A pressure regulator for an ink pen, comprising:

a diaphragm between a lower pressure region and a higher pressure region, the diaphragm movable toward the lower pressure region in response to an increase in a pressure difference across the diaphragm;

a valve operative between an open position in which ink may flow into the lower pressure region and a closed position in which ink may not flow into the lower pressure region;

a first lever rotatable on a first fulcrum in response to movement of the diaphragm toward the lower pressure region; and a second lever connected to the valve, the second lever rotatable on a second fulcrum in response to rotation of the first lever to move the valve from the closed position to an open position.

2. The pressure regulator of claim 1, wherein the first lever rotatable on a first fulcrum in response to movement of the diaphragm toward the lower pressure region comprises the first lever translatable in response to movement of the diaphragm toward the lower pressure region and then rotatable on the first fulcrum in response to further movement of the diaphragm toward the lower pressure region.

3. The pressure regulator of claim 1, further comprising a first spring biasing the diaphragm toward the higher pressure region and a second spring biasing the valve toward the closed position.

4. The pressure regulator of claim 3, wherein the first spring presses the first lever against the diaphragm to bias the diaphragm toward the higher pressure region.

5. The pressure regulator of claim 3, wherein the second spring bears on the second lever to bias the valve toward the closed position.

6. The pressure regulator of claim 3, wherein the first spring and the first lever are combined in a single part and the second spring and the second lever are combined in a single part.

7. An ink pen for an inkjet printer, comprising:

a printhead;

a pressure regulator chamber operatively connected to the printhead such that ink in the pressure regulator chamber may flow to the printhead; and a pressure regulator in the pressure regulator chamber, the pressure regulator comprising:

a diaphragm between a lower pressure region internal to the pressure regulator chamber and a higher pressure region external to the pressure regulator chamber, the diaphragm movable toward the lower pressure region in response to an increase in a pressure difference across the diaphragm;

a valve operative between an open position in which ink may flow into the lower pressure region and a closed position in which ink may not flow into the lower pressure region;

a first lever rotatable on a first fulcrum in response to movement of the diaphragm toward the lower pressure region; and a second lever connected to the valve, the second lever rotatable on a second fulcrum in response to rotation of the first lever to move the valve from the closed position to an open position.

8. The ink pen of claim 7, further comprising a filter chamber in fluid communication with the pressure regulator chamber and a filter disposed in the filter chamber such that ink flowing out of the filter chamber passes through the filter.

9. The ink pen of claim 7, wherein the first lever rotatable on a first fulcrum in response to movement of the diaphragm toward the lower pressure region comprises the first lever translatable in response to movement of the diaphragm toward the lower pressure region and then rotatable on the first fulcrum in response to further movement of the diaphragm toward the lower pressure region.

10. The ink pen of claim 7, further comprising a first spring biasing the diaphragm toward the higher pressure region and a second spring biasing the valve toward the closed position.

11. The ink pen of claim 8, wherein the pressure regulator chamber is located downstream from the filter chamber along a path of ink flow through the pen and the pen further comprises:

an inlet to the filter chamber upstream from the filter along the ink flow path; and an outlet from the filter chamber to the pressure regulator chamber downstream from the filter along the ink flow path such that ink flowing from the inlet to the outlet passes through the filter.

12. The ink pen of claim 10, wherein the first spring and the first lever are combined in a single part and the second spring and the second lever are combined in a single part.

* * * * *